US012440006B2

(12) United States Patent
Jawson

(10) Patent No.: US 12,440,006 B2
(45) Date of Patent: Oct. 14, 2025

(54) INTERCHANGEABLE CHARM JEWELRY

(71) Applicant: Susanne Louise Jawson, Glendale, WI (US)

(72) Inventor: Susanne Louise Jawson, Glendale, WI (US)

( * ) Notice: Subject to any disclaimer, the term of this patent is extended or adjusted under 35 U.S.C. 154(b) by 125 days.

(21) Appl. No.: 17/946,233

(22) Filed: Sep. 16, 2022

(65) Prior Publication Data

US 2023/0255329 A1 Aug. 17, 2023

Related U.S. Application Data

(60) Provisional application No. 63/310,964, filed on Feb. 16, 2022.

(51) Int. Cl.
*A44C 9/00* (2006.01)

(52) U.S. Cl.
CPC ..... *A44C 9/0084* (2013.01)

(58) Field of Classification Search
CPC ... A44C 9/0084; A44C 9/0053; A44C 9/0007; A44C 9/0015; A44C 9/0023; A44C 9/003; A44C 9/0038; A44C 9/0061
See application file for complete search history.

(56) References Cited

U.S. PATENT DOCUMENTS

D56,092 S 8/1920 Weiner et al.
1,920,875 A * 8/1933 Miskend ..... A44C 15/001 24/511
2,016,679 A * 10/1935 Mayer ..... A44C 9/0023 63/3
2,220,408 A * 11/1940 Kalina ..... A44C 9/0015 63/15.3
2,316,225 A * 4/1943 De De Hoffmann ..... A44C 17/0216 63/15

(Continued)

FOREIGN PATENT DOCUMENTS

CA 2919598 C * 7/2021 ..... A44C 13/00
CN 305834851 6/2020

(Continued)

OTHER PUBLICATIONS

Be Charming, Pandora Me Shooting Star Ring Set, believed to be available at least as early as Feb. 16, 2022, 4 pages; https://www.becharming.com/shooting-star-pandora-me-ring-set.html?gclid=EAIaIQobChMIyYC2tM_p-AIVkoRaBR2c5gpKEAQYECABEgKoEPD_BWE.

(Continued)

*Primary Examiner* — Jason W San
*Assistant Examiner* — Anna S Rashid
(74) *Attorney, Agent, or Firm* — FOLEY & LARDNER LLP

(57) ABSTRACT

An item of jewelry may include a first band having at least a first notch, where the first band defines a first continuous annular band. The item of jewelry may also include a second band having at least a first notch and a protrusion. The protrusion may be configured to receive a portion of a decorative item to removably couple the decorative item to the second band, and the second band may define a second continuous annular band. The first notch of the first band may receive a portion of the second band proximate the first notch of the second band, and the first notch of the second band may receive a portion of the first band proximate the first notch of the second band, so as to removably couple the first band and the second band.

18 Claims, 7 Drawing Sheets

(56) References Cited

U.S. PATENT DOCUMENTS

| | | | | | |
|---|---|---|---|---|---|
| D153,203 | S | | 3/1949 | Bergman | |
| 3,307,375 | A | * | 3/1967 | Estrin | A44C 9/0015 D11/89 |
| D254,537 | S | * | 3/1980 | Abelson | D11/27 |
| D254,606 | S | * | 4/1980 | Abelson | 63/15.1 |
| D270,720 | S | | 9/1983 | Schneider | |
| 5,596,887 | A | * | 1/1997 | Bergagnini | A44C 9/0023 63/15.4 |
| 5,669,241 | A | * | 9/1997 | Kohl | A44C 9/0015 63/15.1 |
| D419,102 | S | | 1/2000 | Mestrum | |
| D421,405 | S | | 3/2000 | Mestrum | |
| 6,131,408 | A | | 10/2000 | Gill | |
| 6,412,304 | B1 | * | 7/2002 | Adelman | A44C 17/04 63/26 |
| 6,484,536 | B1 | * | 11/2002 | Gould | A44C 9/0023 63/15.3 |
| 6,701,747 | B2 | * | 3/2004 | Hartgrove | A44C 17/0208 63/15 |
| D495,967 | S | | 9/2004 | Hara | |
| 7,201,021 | B2 | * | 4/2007 | Hartgrove | A44C 15/003 63/29.1 |
| D563,821 | S | | 3/2008 | McKeever et al. | |
| D576,909 | S | | 9/2008 | McKeever et al. | |
| 8,316,666 | B2 | * | 11/2012 | Patterson | A44C 17/0216 63/15.4 |
| 9,380,843 | B2 | * | 7/2016 | Logian | A44C 25/001 |
| 9,439,484 | B2 | * | 9/2016 | Nevatia | A44C 1/00 |
| D882,447 | S | | 4/2020 | Gurung | |
| 10,736,386 | B1 | * | 8/2020 | Hutchins | A44C 15/0025 |
| 11,234,497 | B2 | * | 2/2022 | Hinds | A44C 9/0023 |
| D956,611 | S | | 7/2022 | Prevalsek | |
| 11,766,100 | B1 | * | 9/2023 | Butler | A44C 17/0216 63/29.1 |
| D1,005,878 | S | | 11/2023 | Zhuang | |
| 2002/0170314 | A1 | | 11/2002 | Konieczny | |
| 2003/0074919 | A1 | | 4/2003 | Hartgrove | |
| 2006/0185392 | A1 | * | 8/2006 | Golove | A44C 17/0216 63/29.1 |
| 2008/0034792 | A1 | | 2/2008 | McKeever et al. | |
| 2012/0011888 | A1 | * | 1/2012 | Patterson | A44C 17/0216 63/15 |
| 2014/0196500 | A1 | * | 7/2014 | Machini | A44C 9/003 63/15 |
| 2015/0026500 | A1 | * | 1/2015 | Bisserier | A44C 9/0007 63/15 |
| 2015/0121958 | A1 | * | 5/2015 | Murray | A44C 9/0023 63/15.1 |
| 2017/0055647 | A1 | * | 3/2017 | Samanta | A44C 17/0208 |
| 2018/0177265 | A1 | * | 6/2018 | Kadar | A44C 9/0092 |
| 2019/0239603 | A1 | * | 8/2019 | Fogel | A44C 9/00 |
| 2021/0100324 | A1 | * | 4/2021 | Ballantine | A44C 27/00 |
| 2021/0153612 | A1 | * | 5/2021 | Arendsen | A44C 17/0233 |
| 2021/0186167 | A1 | * | 6/2021 | Roi-Sanginario | A44C 7/002 |
| 2021/0298431 | A1 | * | 9/2021 | Maddocks | A44C 13/00 |
| 2023/0255329 | A1 | | 8/2023 | Jawson | |
| 2023/0346086 | A1 | * | 11/2023 | Ostanin | A44C 17/02 |
| 2023/0371659 | A1 | * | 11/2023 | Ringer | A44C 5/04 |
| 2024/0016262 | A1 | * | 1/2024 | Jensen | A44C 5/2066 |

FOREIGN PATENT DOCUMENTS

| | | | | |
|---|---|---|---|---|
| KR | 3020180000726 | | 5/2018 | |
| RU | 00055431 | | 10/2004 | |
| RU | 00062636 | | 5/2007 | |
| RU | 218072 | U1 * | 5/2023 | |
| WO | WO-2012066584 | A1 * | 5/2012 | A44C 9/0023 |
| WO | WO-D097570-002 | | 9/2017 | |
| WO | WO-D214303-004 | | 10/2021 | |

OTHER PUBLICATIONS

Etsy, Interlocking Pear Opal and Diamond Wedding Ring Set in 14K Gold, Crossover Bridal Set, Chevron V Stack Band, Alternate Engagement Ring, believed to be available at least as early as Feb. 16, 2022, 13 pages; https://www.etsy.com/listing/758660954/interlocking-pear-opal-and-diamond?gpla=1&gao=1&.

Inspiranza Designs, She Shines Ring, believed to be available at least as early as Feb. 16, 2022; 5 pages; https://inspiranzadesigns.com/products/she-shines-ring?gadid=&gclid=EAIaIQobChMljt3J6b3p-AIVZsLCBB3E5AlvEAQYCSABEgLKMvD_BwE&utm_campaign=16472731655&utm_content=&utm_medium=paid&utm_source=google&utm_term=.

Azaggi 925 Sterling Silver Band Ring, Amazon.com, Date first available: Oct. 6, 2016, [site visited: Apr. 29, 2024], Available from URL: https://a.co/d/h4AzQrb (Year: 2016) 4 pages.

Han Han, 14k White Gold Plated Wedding Rings, Amazon.com, Date first available: Sep. 1, 2016, [site visited: Apr. 29, 2024] Available from URL: https://a.co/d/gbbUj62 (Year: 2016) 10 pages.

Minimal Charm Diamond Ring, tanishq.co.in, No date available, [site visited Apr. 29, 2024], Available from URL: https://www.tanishq.co.in/product/minimal-charm-diamond-ring-50d2cafbjaa09.html?lang=en (Year: NA) (Year: NA) 3 pages.

* cited by examiner

INTERCHANGEABLE CHARM JEWELRY

CROSS-REFERENCE TO RELATED PATENT APPLICATIONS

This application claims the benefit of and priority to U.S. Provisional Application No. 63/310,964, filed on Feb. 16, 2022, the entire disclosure of which is hereby incorporated by reference herein.

BACKGROUND

The present disclosure relates generally to an item of jewelry. More specifically, the present disclosure relates to an item of jewelry that interchangeably couples with one or more decorative charms.

SUMMARY

At least one embodiment relates to an item of jewelry for displaying a decorative item. The item of jewelry may include a first band having at least a first notch, wherein the first band defines a first continuous annular band. The item of jewelry may also include a second band having at least a first notch and a protrusion. The protrusion may be configured to receive a portion of a decorative item to removably couple the decorative item to the second band, where the second band defines a second continuous annular band. The first notch of the first band may receive a portion of the second band proximate the first notch of the second band, and the first notch of the second band may receive a portion of the first band proximate the first notch of the second band so as to removably couple the first band and the second band.

Another embodiment relates to a method of providing an item of jewelry. The method may include providing a first band having at least a first notch, wherein the first band defines a first continuous annular band. The method may include providing a second band having at least a first notch and a protrusion. The protrusion may be configured to receive a portion of a decorative item to removably couple the decorative item to the second band, where the second band defines a second continuous annular band. The first notch of the first band may receive a portion of the second band proximate the first notch of the second band, and the first notch of the second band may receive a portion of the first band proximate the first notch of the second band so as to removably couple the first band and the second band.

Another embodiment relates to a jewelry system. The jewelry system may include a decorative item. The jewelry system may also include a first band having at least a first notch, wherein the first band defines a first continuous annular band. The item of jewelry may also include a second band having at least a first notch and a protrusion. The protrusion may be configured to receive a portion of a decorative item to removably couple the decorative item to the second band, where the second band defines a second continuous annular band. The first notch of the first band may receive a portion of the second band proximate the first notch of the second band, and the first notch of the second band may receive a portion of the first band proximate the first notch of the second band so as to removably couple the first band and the second band.

This summary is illustrative only and should not be regarded as limiting.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

The present disclosure generally relates to an item of jewelry configured to removably couple one or more decorative charms, in order to provide versatile and interchangeable displays of decorative items to accommodate user preferences, use sceneries, and/or design considerations is shown, according to various embodiments. In some embodiments, the item of jewelry includes a first band and a second band that removably couple. For example, the first band and the second band may de-couple to remove/receive at least a portion of a decorative item (e.g., a connector ring included in the decorative item), and couple to secure the decorative (e.g., ornamental, ornate, embellishment, embellished, adornment, adorned, etc.) item for display to a user or observer. The first band and the second band may further include interlocking portions (e.g., notches, mechanical interlocks, etc.), which may be configured to engage opposing bands, so as to limit/permit movement of the first band relative to the second band to selectively couple. Further, the second band may include a protrusion having an engagement tip, and the first band may include a receiver. The protrusion may be configured to engage (e.g., receive, hold, couple, etc.) a portion of a decorative item, for example to display the decorative item to a user or observer. Further, the engagement tip of the second band may be received by the receiver of the first band, for example to limit/permit movement of the first band relative to the second band and/or position the first band relative to the second band.

Figure 1:
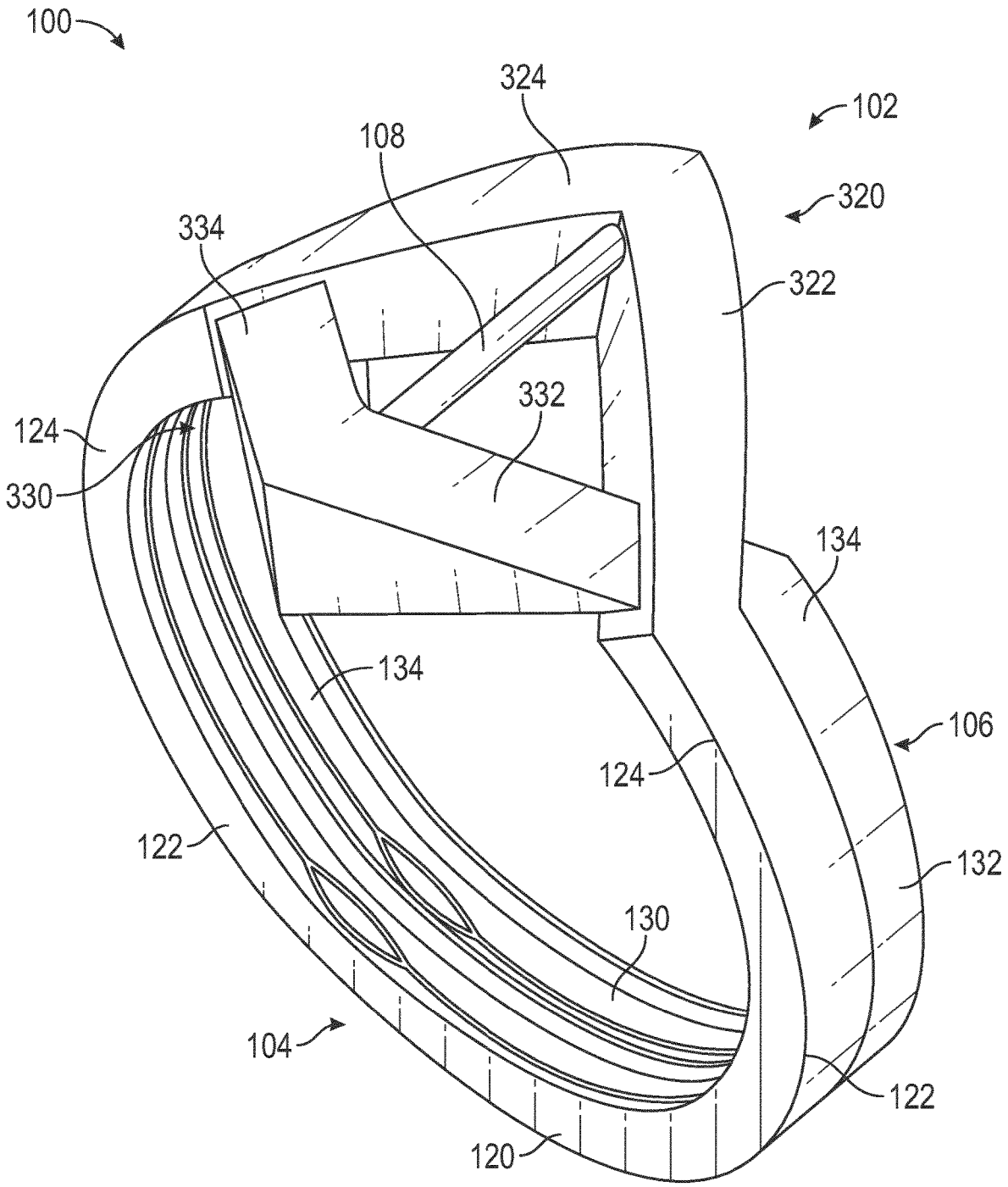
FIG. 1 is a perspective view of an item of jewelry, according to some embodiments.

Referring generally to FIG. 1, a jewelry system 100 is shown, according to some embodiments. The jewelry system 100 may include an item of jewelry 102 that may removably couple one or more decorative items. The item of jewelry 102 may be configured to engage an anatomical feature of a user and display the one or more decorative items. For example, the item of jewelry 102 may be a ring that removably couples a charm and engages a finger or toe of a user to display the charm. In some embodiments, the item of jewelry 102 is another suitable decorative item (e.g., a band, bangle, armlet, crown, anklet, etc.) that removably couples another decorative item (e.g., a charm, bead, gemstone, etc.) and/or engages another feature of a user (e.g., hand, arm, head, neck, ankle, foot, etc.) to display the decorative item.

Figure 10:
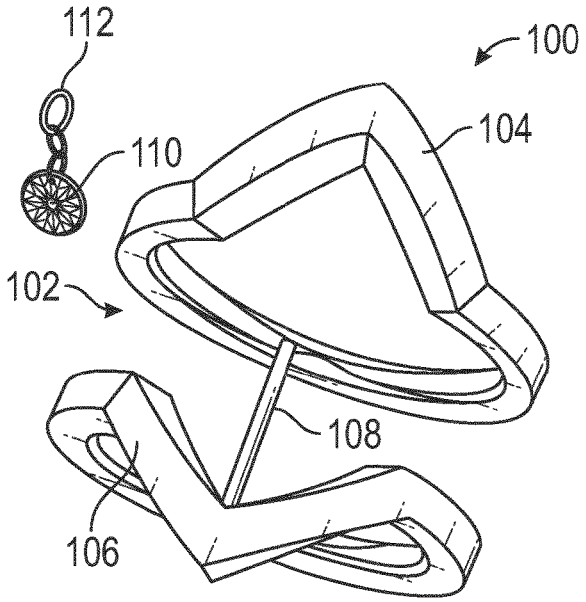
FIG. 10 is a top view of a first band and a second band of the item of jewelry of FIG. 1.
Figure 11:
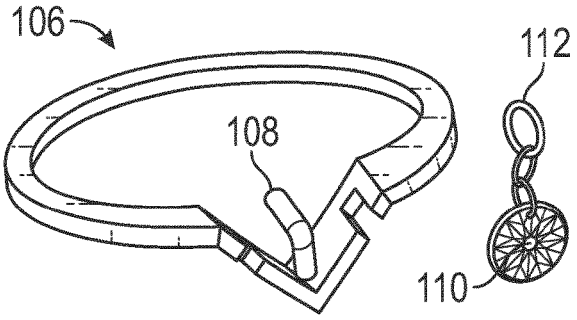
FIG. 11 is a perspective view of a band of the item of jewelry of FIG. 1 and a decorative item, according to some embodiments.

The item of jewelry 102 includes at least one (annular) first band 104 and at least one (annular) second band 106, according to some embodiments. The first band 104 and the second band 106 may be configured to removably couple, for example the first band 104 and the second band 106 may de-couple to remove/receive at least a portion of a decorative item (as shown in FIGS. 10-11) and couple to form the item of jewelry 102 (as shown in FIG. 1). The first band 104 and/or the second band 106 may be continuous and annular. The first band 104 and/or the second band 106 may be formed of a metal. For example, the first band 104 and/or the second band 106 may be a continuous (e.g., uninterrupted, unbroken, uniform, etc.) annular band, and may be formed of titanium, zirconium, tungsten, steel, or another suitable metal. In other embodiments, the first band 104 and/or the second band 106 are another suitable configuration or shape (e.g., non-uniform, modular, segmented, separated, square, hexagonal, octagonal, decagonal, etc.) and/or formed of another suitable material (e.g., plastic, wood, stone, glass, etc.).

The item of jewelry 102 also includes at least one protrusion 108, according to some embodiments. As will be discussed in greater detail below, the protrusion 108 may be coupled to the second band 106, and may extend from the second band 106 so as to removably couple (e.g., receive, secure, hold, etc.) one or more decorative items. In some embodiments, the protrusion 108 is a uniform hook having a curved surface and an engagement tip; however, in other embodiments the protrusion is a peg, catch, clasp, pin, clip, or another suitable projection configured to removably couple a decorative item. The protrusion 108 may also removably couple the first band 104. For example, the protrusion 108 may engage the first band 104 when the first band 104 is coupled to the second band 106 to limit movement of the first band 104 relative to the second band 106 (e.g., downward, horizontal, forward/backward, pitch, yaw, roll, etc.).

Figure 2:
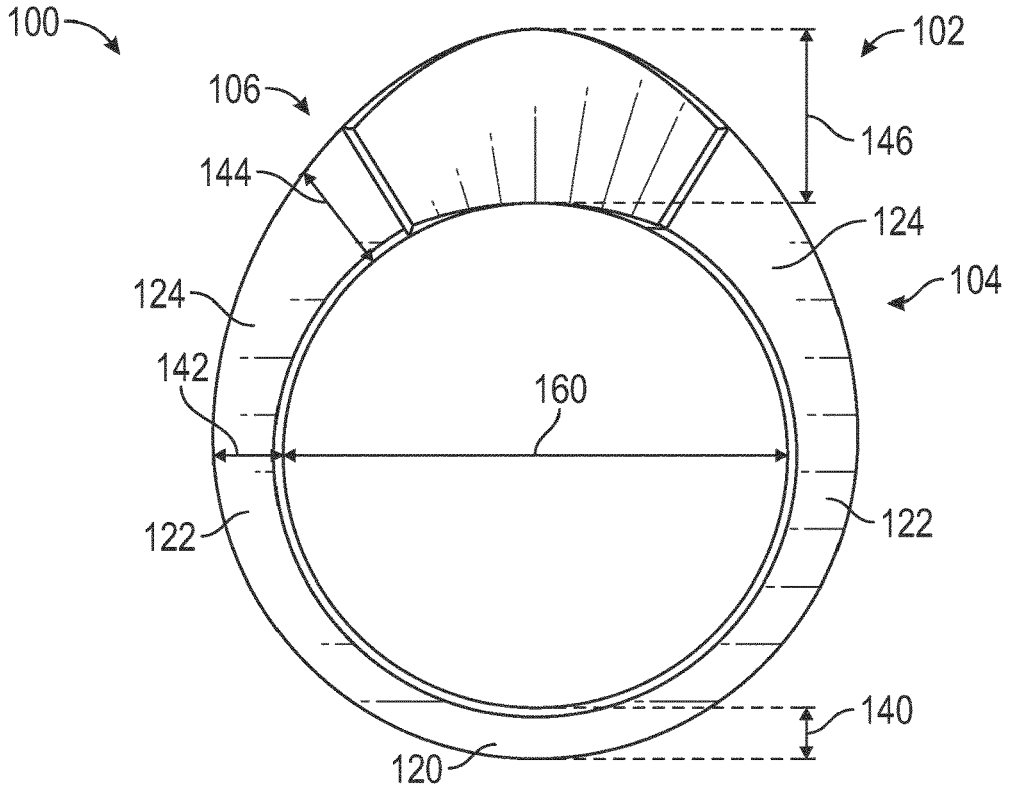
FIG. 2 a front view of the item of jewelry of FIG. 1.
Figure 3:
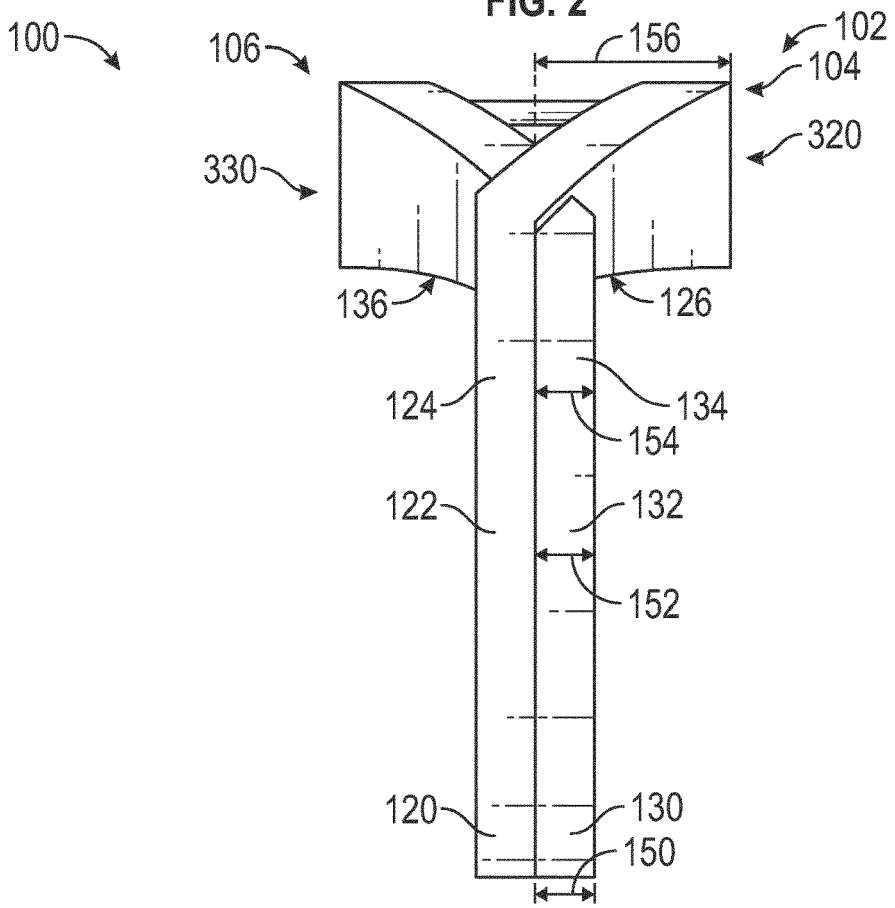
FIG. 3 is a side view of the item of jewelry of FIG. 1.

Referring to FIGS. 1-9, the first band 104 and/or the second band 106 include a base, one or more shanks, one or more shoulders, and a bridge, according to some embodiments. For example, the first band 104 may include a base 120, at least one shank 122, at least one shoulder 124, and a bridge 126 (as shown in FIGS. 2-3). The second band 106 may include a base 130, at least one shank 132, at least one shoulder 134, and a bridge 136 (as shown in FIG. 3). The base (e.g., the base 120, the base 130) may form a bottom portion of the band (e.g., the first band 104, the second band 106), and may extend to and couple with two opposing shanks (e.g., shanks 122, shanks 132). The shanks (e.g., the shanks 122, the shanks 132) may extend from opposing sides of the base, and may form exterior portions of the band (as shown in FIG. 2). The shanks may also extend to and couple with the shoulders (e.g., the shoulder 124, the shoulder 134) of the band (as shown in FIG. 2). The shoulders (e.g., the shoulders 124, the shoulders 134) may form top-exterior portions of the band, and may extend to either side of the bridge (e.g., the bridge 126, the bridge 136). The bridge may form the top portion of the band. The base, the shanks, the shoulders, and the bridge may be coupled so as to form a continuous first band 104 and/or a continuous second band 106 (as shown in FIG. 1). In some embodiments, the base, the shanks, the shoulders, and/or the bridge are non-uniform (e.g., modular, segmented, separated, etc.), such that components of the first band 104 and/or the second band 106 are separable.

In some embodiments, the base, the shanks, the shoulders, and the bridge of the first band 104 and/or the second band 106 define a thickness (e.g., height) and a width. For example, the base (e.g., the base 120, the base 130) may define a base thickness 140 of about (e.g., within 10%) 1.5 millimeters, the shanks (e.g., the shank 122, the shank 132) may define a shank thickness 142 of about (e.g., within 10%) 1.6 millimeters, the shoulders (e.g., the shoulder 124, the shoulder 134) may define a shoulder thickness 144 of about (e.g., within 10%) 3.1 millimeters, and/or the bridge (e.g., the bridge 126, the bridge 136) may define a bridge thickness 146 of about (e.g., within 10%) 6.0 millimeters (as shown in FIG. 2). In some embodiments, the base thickness 140, the shank thickness 142, the shoulder thickness 144, and/or the bridge thickness 146 of the first band 104 and the second band 106 are the same; however, in other embodiments the thickness (e.g., thickness 140, 142, 144, and/or 146) of the first band 104 and the second band 106 are different. The base (e.g., the base 120, the base 130) may also define a base width 150, the shanks (e.g., the shank 122, the shank 132) may define a shank width 152, the shoulders (e.g., the shoulder 124, the shoulder 134) may define a shoulder width 154, and/or the bridge (e.g., the bridge 126, the bridge 136) may define a bridge width 156 (as shown in FIG. 3). In some embodiments, the base width 150, the shank width 152, and the shoulder width 154 are about (e.g., within 10%) 4.0 millimeters; however, in other embodiments the widths (e.g., the width 150, 152, and/or 154) are another suitable width (e.g., 0.75, 1, 1.25, 1.5, 1.75, 2, 2.5, 3, 5, etc. millimeters). Similar to the thicknesses, the widths (e.g., the width 150, 152, 154, and/or 156) of the first band 104 and the second band 106 may be the same (as shown in FIG. 3), or different. The shanks (e.g. the shanks 122, the shanks 132) of the first band 104 and/or the second band 106 may be separated by a distance 160, so as to form a space (e.g., void, opening, receiving area, etc.) for an anatomical feature of the user to engage the first band 104 and/or the second band 106 (as shown in FIG. 2). For example, the first band 104 and/or the second band 106 may have a distance 160 of about (e.g., within 10%) 17.5 millimeters. However, in other embodiments, the distance 160 may be another suitable distance (e.g., 15.5, 15.9, 16.3, 16.7, 18.8, 19.2, 19.6, 20.0, 20.4, etc. millimeters).

Figure 6:
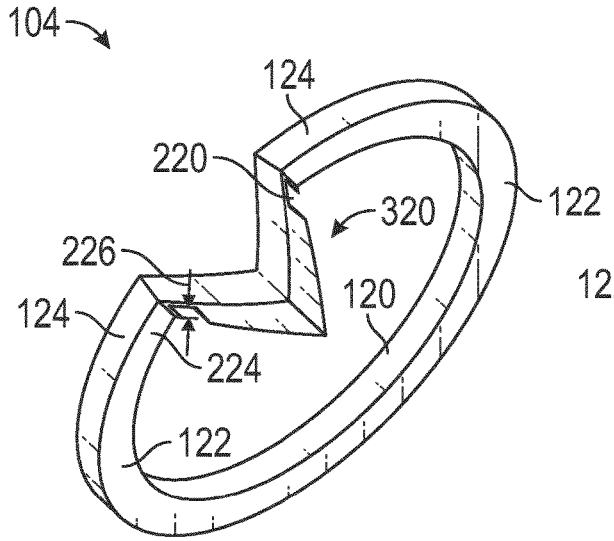
FIG. 6 is a top view of a first band of the item of jewelry of FIG. 1.
Figure 7:
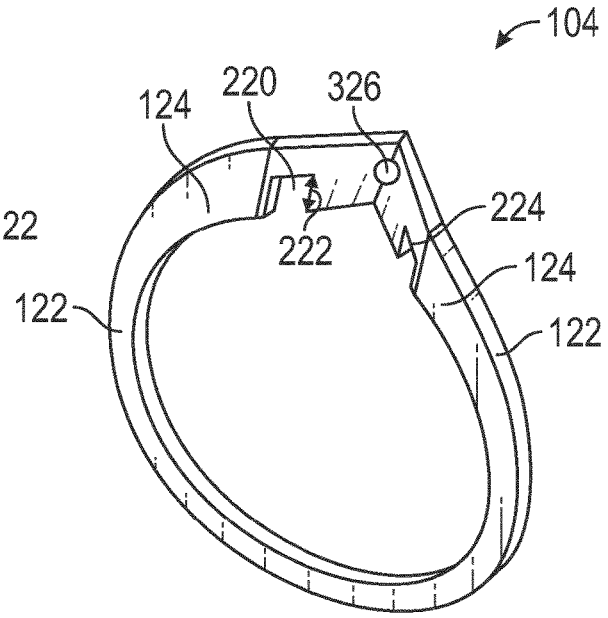
FIG. 7 is another top view of a first band of the item of jewelry of FIG. 1.

The first band 104 includes at least one interlocking portion, shown as at least one first notch 220, according to some embodiments. The first notch 220 may be configured to receive a portion of the second band 106, for example to removably couple the first band 104 and the second band 106. In some embodiments, the first notch 220 is positioned at the shoulder 124 of the first band 104 (as shown in FIGS. 6-7). However, in other embodiments the first notch 220 is positioned at another portion of the first band 104 (e.g., the bridge 126, a shank 122, both shanks 122, the base 120, etc.). The first notch 220 may extend into an interior surface of the first band 104 an interlocking distance 222 (as shown in FIG. 7), which may be the distance of half a thickness of the first band 104 (e.g., half a thickness of the shoulder 124, the shank 122, the base 120, etc.). In other embodiments, the first notch 220 extends into another surface of the first band 104 (e.g., a front/rear surface, an exterior surface, a side surface, etc.) and/or the interlocking distance 222 is another suitable distance (e.g., 0.5, 0.75, 1.0, 1.25, 1.5, 1.75, etc. millimeters). While the at least one interlocking portion of the first band 104 is described herein as being the first notch 220, it should be understood that the first notch 220 may be another suitable interlocking component (e.g., a clasp, latch, hook, magnet, etc.).

Figure 8:
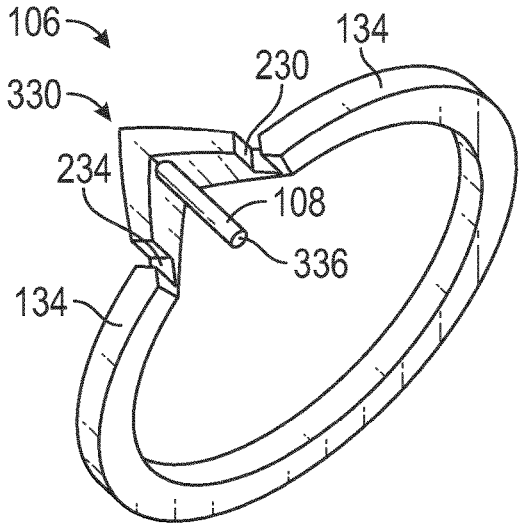
FIG. 8 is a top view of a second band of the item of jewelry of FIG. 1.
Figure 9:
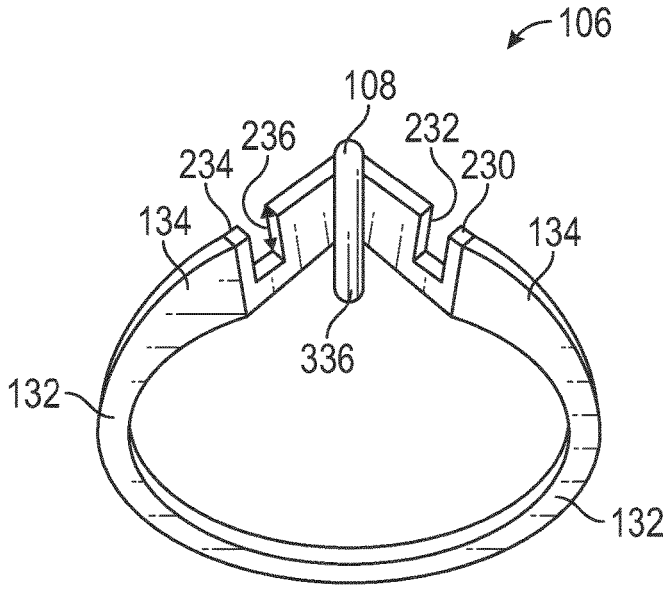
FIG. 9 is a front view of a second band of the item of jewelry of FIG. 1.

The second band 106 includes at least one interlocking portion, shown as at least one first notch 230, according to some embodiments. The first notch 230 may be configured to receive a portion of the first band 104, for example to removably couple the second band 106 and the first band 104. In some embodiments, the first notch 230 is positioned at the shoulder 134 of the second band 106 (as shown in FIGS. 8-9). However, in other embodiments the first notch 230 is positioned at another portion of the second band 106 (e.g., the bridge 136, a shank 132, both shanks 132, the base 130, etc.). The first notch 230 may extend into an exterior surface of the second band 106 an interlocking distance 232 (as shown in FIG. 9), which may be the distance of half a thickness of the second band 106 (e.g., half a thickness of the shoulder 134, the shank 132, the base 130, etc.). In some embodiments, the interlocking distance 232 of the first notch 230 of the second band 106, and the interlocking distance 222 of the first notch 220 of the first band 104 are the same; however, in other embodiments the interlocking distance 232 and the interlocking distance 222 are different. In other embodiments, the first notch 230 extends into another surface of the second band 106 (e.g., a front/rear surface, an interior surface, a side surface, etc.) and/or the interlocking distance 232 is another suitable distance (e.g., 0.5, 0.75, 1.0, 1.25, 1.5, 1.75, etc. millimeters). While the at least one interlocking portion of the second band 106 is described herein as being the first notch 230, it should be understood that the first notch 230 may be another suitable interlocking component (e.g., a clasp, latch, hook, magnet, etc.).

Figure 5:
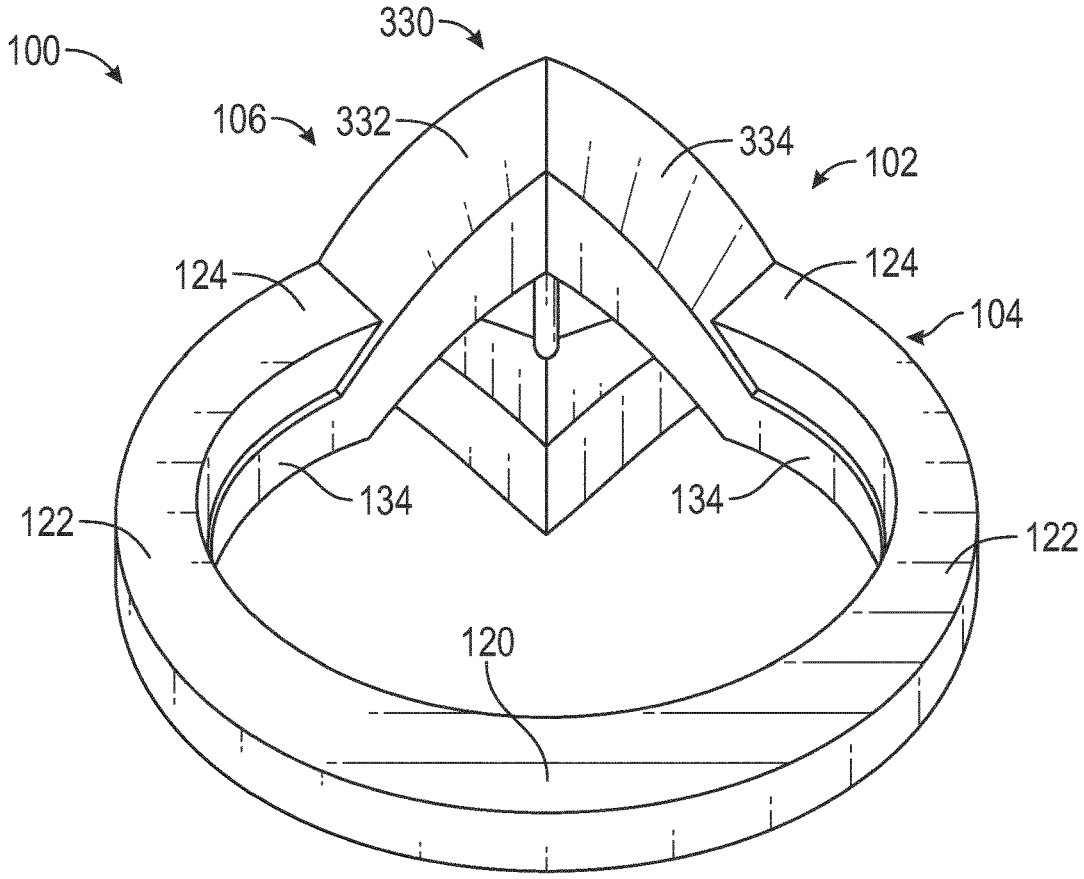
FIG. 5 is a bottom view of the item of jewelry of FIG. 1.

The first notch 220 of the first band 104 may receive a portion of the second band 106, and the first notch 230 of the second band 106 may receive a portion the first band 104, such that the first band 104 and the second band 106 removably couple. For example, the first notch 220 of the first band 104 and the first notch 230 of the second band 106 may mate (e.g., engage, form opposing notches, form counterpart notches, etc.), such that a portion of the first band 104 is received by the first notch 230 of the second band 106 and a portion of the second band 106 is received by the first notch 220 of the first band 104 (as shown in FIGS. 1 and 5). The first notch 220 and the first notch 230 may receive portions of the second band 106 and the first band 104, respectively, such that the first band 104 and second band 106 are removably coupled and limit/permit selective movement. For example, the first band 104 and the second band 106 may couple so as to limit translational (e.g., horizontal, forward/backward, pitch, yaw, roll, etc.) movement of the first band 104 relative to the second band 106. Further, the first band 104 and the second band 106 may removably couple so as to permit vertical (e.g., upward) movement of the first band 104 relative to the second band 106. As indicated above, the interlocking distance 222 of the first notch 220 of the first band 104, and the interlocking distance 232 of the first notch 230 of the second band 106 may be the same, such that the first band 104 and the second band 106 are aligned (e.g., flush on an exterior surface of the bands, etc.) when coupled (as shown in FIG. 1). In other embodiments, the interlocking distance 222 and the interlocking distance 232 are different, such that the first band 104 and the second band 106 form another configuration (e.g., staggered, stair-stepped, etc.) when coupled.

The first band 104 may also include at least another interlocking portion, shown as at least one second notch 224. Similar to the first notch 220 of the first band 104, the second notch 224 may be configured to receive a portion of the second band 106, for example to removably couple the first band 104 and the second band 106. In some embodiments, the second notch 224 is positioned at a shoulder 124 of the first band 104, for example an opposing shoulder 124 of the first band 104 relative to the first notch 220 (as shown in FIGS. 6-7). However, in other embodiments the second notch 224 is positioned at another portion of the first band 104 (e.g., the bridge 126, a shank 122, both shanks 122, the base 120, etc.). The second notch 224 may extend into an interior surface of the first band 104 an interlocking distance 226 (as shown in FIG. 6), which may be the distance of half a thickness of the first band 104 (e.g., half a thickness of the shoulder 124, the shank 122, the base 120, etc.). The interlocking distance 226 of the second notch 224 may be the same as the interlocking distance 222 of the first notch 220; however, in some embodiments the interlocking distance 226 and the interlocking distance 222 are different. In other embodiments, the second notch 224 extends into another surface of the first band 104 (e.g., a front/rear surface, an exterior surface, a side surface, etc.) and/or the interlocking distance 226 is another suitable distance (e.g., 0.5, 0.75, 1.0, 1.25, 1.5, 1.75, etc. millimeters). While the at least one other interlocking portion of the first band 104 is described herein as being the second notch 224, it should be understood that the second notch 224 may be another suitable interlocking component (e.g., a clasp, latch, hook, magnet, etc.).

The second band 106 may also include at least another interlocking portion, shown as at least one second notch 234. Similar to the first notch 230 of the second band 106, the second notch 234 may be configured to receive a portion of the first band 104, for example to removably couple the second band 106 and the first band 104. In some embodiments, the second notch 234 is positioned at the shoulder 134 of the second band 106, for example an opposing shoulder 134 of the second band 106 relative to the first notch 230 (as shown in FIGS. 8-9). However, in other embodiments the second notch 234 is positioned at another portion of the second band 106 (e.g., the bridge 136, a shank 132, both shanks 132, the base 130, etc.). The second notch 234 may extend into an exterior surface of the second band 106 an interlocking distance 236 (as shown in FIG. 9), which may be the distance of half a thickness of the second band 106 (e.g., half a thickness of the shoulder 134, the shank 132, the base 130, etc.). The interlocking distance 236 of the second notch 234 may be the same as the interlocking distance 232 of the first notch 230; however, in some embodiments the interlocking distance 236 and the interlocking distance 232 are different. Further, in some embodiments the interlocking distance 236 of the second notch 234 of the second band 106, and the interlocking distance 226 of the second notch 224 of the first band 104 are the same; however, in other embodiments the interlocking distance 236 and the interlocking distance 226 are different. In other embodiments, the second notch 234 extends into another surface of the second band 106 (e.g., a front/rear surface, an interior surface, a side surface, etc.) and/or the interlocking distance 236 is another suitable distance (e.g., 0.5, 0.75, 1.0, 1.25, 1.5, 1.75, etc. millimeters). While the at least one other interlocking portion of the second band 106 is described herein as being the second notch 234, it should be understood that the second notch 234 may be another suitable interlocking component (e.g., a clasp, latch, hook, magnet, etc.).

The second notch 224 of the first band 104 may receive a portion of the second band 106, and the second notch 234 of the second band 106 may receive a portion of the first band 104, such that the first band 104 and the second band 106 removably couple. For example, the second notch 224 of the first band 104 and the second notch 234 of the second band 106 may mate (e.g., engage, form opposing notches, form counterpart notches, etc.), such that a portion of the first band 104 is received by the second notch 234 of the second band 106 and a portion of the second band 106 is received by the second notch 224 of the first band 104 (as shown in FIGS. 1 and 5). Similar to the first notches 220, 230 discussed above, the second notch 224 and the second notch 234 may receive portions of the second band 106 and the first band 104, respectively, such that the first band 104 and second band 106 are removably coupled and limit/permit selective movement. For example, the first band 104 and the second band 106 may couple so as to limit translational movement (e.g., horizontal, forward/backward, pitch, yaw, roll, etc.) and/or permit vertical movement (e.g., upward) of the first band 104 relative to the second band 106. As indicated above, the interlocking distance 226 of the second notch 224 of the first band 104, and the interlocking distance 236 of the second notch 234 of the second band 106 may be the same, such that the first band 104 and the second band 106 are aligned (e.g., flush on an exterior surface of the bands, etc.) when coupled (as shown in FIG. 1). In other embodiments, the interlocking distance 226 and the interlocking distance 236 are different, such that the first band 104 and the second band 106 form another configuration (e.g., staggered, stair-stepped, etc.) when coupled.

Figure 4:
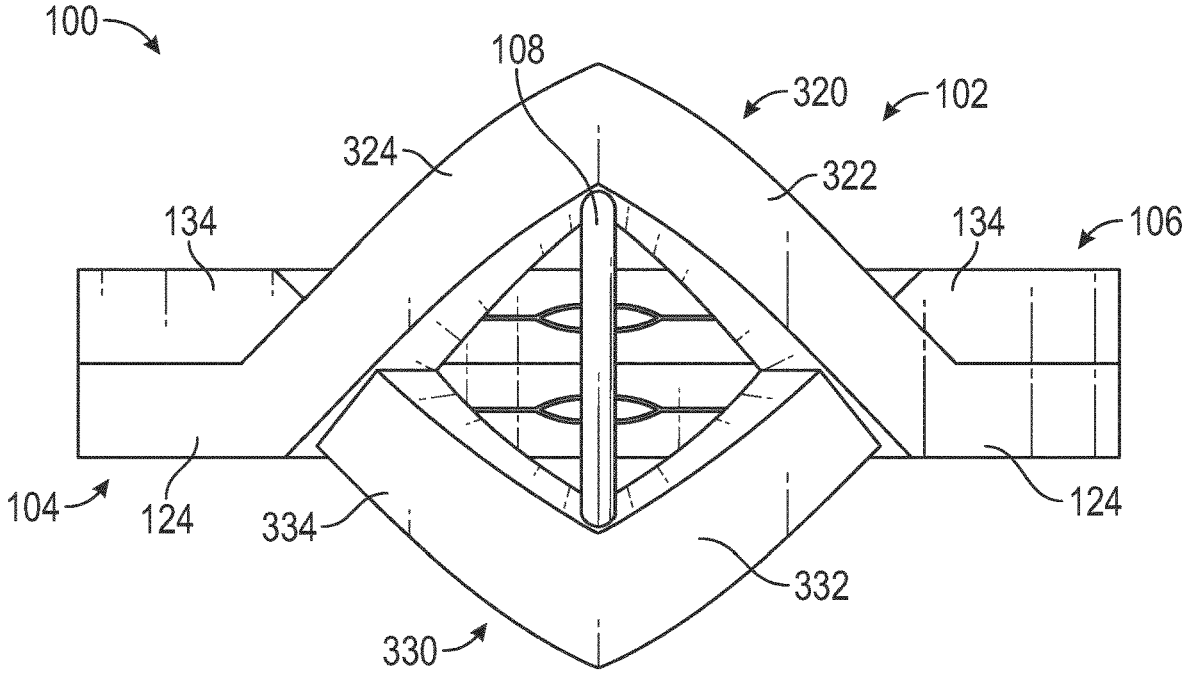
FIG. 4 is a top view of the item of jewelry of FIG. 1.

The first band 104 includes a first offset 320, according to some embodiments. The first offset 320 may extend from the first band 104, for example to form an opening to receive or display a decorative item (as shown in FIGS. 4 and 6). The first offset 320 may extend between the shoulders 124 of the first band 104, for example coupling the shoulder 124 to an opposing shoulder 124 (as shown in FIG. 1 and FIG. 4). In this regard, in some embodiments the first offset 320 of the first band 104 acts as the bridge 136 of the first band 104. The first offset 320 may extend from the first band 104 in a direction that is misaligned with a plane of the first band 104. For example, the first offset 320 may extend in a direction that is misaligned with (e.g., angled from, perpendicular to, etc.) a plane that defines the base 120, the shanks 122, and the shoulders 124 of the first band 104 (as shown in FIGS. 1 and 3).

The first offset 320 may also include at least one first offset arm 322 and/or at least one second offset arm 324. The first offset arm 322 and/or the second offset arm 324 may extend from the first band 104 in a direction that is misaligned with a plane of the first band 104. For example, the first offset arm 322 and/or the second offset arm 324 may extend from the first band 104 in a direction that is misaligned with (e.g., angled from, perpendicular to, etc.) a plane that defines the base 120, the shanks 122, and the shoulders 124 of the first band 104 (as shown in FIGS. 1 and 3). The first offset arm 322 may extend from the first band 104 along a first axis, and the second offset arm 324 may extend from the first band 104 along a second axis. The first offset arm 322 and the second offset arm 324 may extend from the first band 104 and couple at a point a distance from the first band 104 (as shown in FIG. 1). In some embodiments, the first offset arm 322 and the second offset arm 324 couple to form a ninety degree angle (e.g., the first axis and the second axis are perpendicular); however, in other embodiments the first offset arm 322 and the second offset arm 324 couple to form another angle (e.g., 30, 45, 60, 75, 120, 150, etc. degrees). While the first offset 320 is described herein as having a first offset arm 322 and a second offset arm 324 that couple to form a ninety degree angle, it should be understood that the first offset 320 may include fewer, additional, or different components, for example to form different offset configurations (e.g., semi-circle, half-rectangular, half-square, de-coupled offset arms, staggered offset arms, etc.), as discussed below.

The first offset 320 may also include at least one receiver, shown as dimple 326 (as shown in FIG. 7). The dimple 326 may be configured to engage (e.g., receive, couple, etc.) one or more components of the second band 106, such that the first band 104 and the second band 106 may removably couple and limit/permit selective movement. For example, the dimple 326 may engage the protrusion 108 of the second band 106 so as to selectively couple the first band 104 and the second band 106. Further, the dimple 326 may engage the protrusion 108 so as to limit movement of the first band 104 in a first direction (e.g., downward, forward/backward, pitch, yaw, roll, etc.) and/or permit movement of the first band 104 in a second direction (e.g., upward). In some embodiments, the dimple 326 is a semi-circular concave shape and positioned at an interior surface of the first offset 320, for example at a junction of the first offset arm 322 and the second offset arm 324 (as shown in FIG. 7). However, in other embodiments the dimple 326 is another suitable shape or configuration (e.g., square, rectangular, triangular, concave, convex, etc.) and/or is positioned at another portion of the first offset 320 (e.g., at the first offset arm 322, at the second offset arm 324, etc.). While the at least one receiver of the first offset 320 is descried herein as being the dimple 326, it should be understood that the dimple 326 may be another suitable receiving component (e.g., a clasp, latch, magnet, etc.).

The second band 106 may also include a second offset 330. The second offset 330 may extend from the second band 106, for example to form an opening to receive or display a decorative item (as shown in FIGS. 4 and 8). The second offset 330 may extend between the shoulders 134 of the second band 106, for example coupling the shoulder 134 to an opposing shoulder 134 (as shown in FIG. 1 and FIG. 4). In this regard, in some embodiments the second offset 330 of the second band 106 acts as the bridge 136 of the second band 106. The second offset 330 may extend from the second band 106 in a direction that is misaligned with a plane of the second band 106. For example, the second offset 330 may extend in a direction that is misaligned with (e.g., angled from, perpendicular to, etc.) a plane that defines the base 130, the shanks 132, and the shoulders 134 of the second band 106 (as shown in FIGS. 1 and 3). In some embodiments, the first offset 320 of the first band 104 extends in a first direction that is misaligned with a plane of the first band 104, and the second offset 330 of the second band 106 extends in a second direction that is misaligned with a plane of the second band 106. For example, the first direction and the second direction may be opposing directions, within the same plane (as shown in FIG. 3). In other embodiments, the first direction and the second direction are angled relative to one another (e.g., 30, 45, 60, 90, 120, etc. degrees).

The second offset 330 may also include at least one first offset arm 332 and/or at least one second offset arm 334. The first offset arm 332 and/or the second offset arm 334 may extend from the second band 106 in a direction that is misaligned with a plane of the second band 106. For example, the first offset arm 332 and/or the second offset arm 334 may extend from the second band 106 in a direction that is misaligned with (e.g., angled from, perpendicular to, etc.) a plane that defines the base 130, the shanks 132, and the shoulders 134 of the second band 106 (as shown in FIGS. 1 and 3). The first offset arm 332 may extend from the second band 106 along a first axis, and the second offset arm 334 may extend from the second band 106 along a second axis. The first offset arm 332 and the second offset arm 334 may extend from the second band 106 and couple at a point a distance from the second band 106 (as shown in FIG. 1). In some embodiments, the first offset arm 332 and the second offset arm 334 couple to form a ninety degree angle (e.g., the first axis and the second axis are perpendicular); however, in other embodiments the first offset arm 332 and the second offset arm 334 couple to form another angle (e.g., 30, 45, 60, 75, 120, 150, etc. degrees). While the second offset 330 is described herein as having a first offset arm 332 and a second offset arm 334 that couple to form a ninety degree angle, it should be understood that the second offset 330 may include fewer, additional, or different working components to form different offset configurations (e.g., semi-circle, half-rectangular, half-square, de-coupled offset arms, staggered offset arms, etc.), as discussed below.

Figure 12:
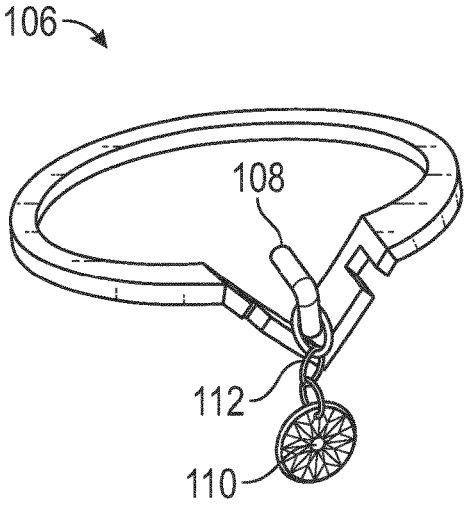
FIG. 12 is a top view of a band of the item of jewelry of FIG. 1 coupled with a decorative item, according to some embodiments.

The second offset 330 is coupled to the protrusion 108, according to some embodiments. As discussed briefly above, the protrusion 108 may extend from the second offset 330, and may be configured to removably couple (e.g., receive, secure, hold, etc.) one or more decorative items. In some embodiments, the protrusion 108 extends from the second offset 330 toward a plane of the second band 106, for example into the opening formed by the second offset 330 (as shown in FIG. 8). The protrusion 108 may extend from an interior surface of the second offset 330 in a direction that is misaligned with the second band 106. For example, the protrusion 108 may extend from the second offset 330 in a direction that is misaligned with (e.g., angled from, perpendicular to, etc.) a plane that defines the base 130, shanks 132, and the shoulders 134 of the second band 106 (as shown in FIG. 1). The protrusion 108 may extend from the second offset 330 at a junction of the first offset arm 332 and the second offset arm 334, or another suitable portion of the second offset 330 (e.g., the first offset arm 332, the second offset arm 334, etc.). In some embodiments, the protrusion 108 is a uniform hook having a curved surface, for example to selectively engage a decorative item (as shown in FIGS. 9 and 11-12). However, in other embodiments, the protrusion 108 is another suitable component or configuration to removably couple a decorative item (e.g., peg, catch, clasp, pin, clip, magnet, dis-connected, segmented, or another suitable component or configuration).

The protrusion 108 may also include at least one engagement tip, shown as ball tip 336 (as shown in FIGS. 8-9). As discussed briefly above, the ball tip 336 may be positioned at a tip of the protrusion 108, and may be configured to removably couple the first band 104. In some embodiments, the ball tip 336 is configured to engage a receiver (e.g., the dimple 326) of the first band 104, so as to removably couple and limit/permit selective movement of the first band 104 relative to the second band 106. For example, the ball tip 336 may be received by the dimple 326 so as to selectively couple the first band 104 and the second band 106. Further, the ball tip 336 may be received by the dimple 326 so as to limit movement of the first band 104 in a first direction (e.g., downward, forward/backward, pitch, yaw, roll, etc.) and/or permit movement of the first band 104 in a second direction (e.g., upward). In some embodiments, the ball tip 336 is a spherical shape configured to compliment the configuration of the dimple 326 (e.g., semi-circular concave shape of the dimple 326). However, in other embodiments the ball tip 336 is another suitable shape or configuration (e.g., hook, clasp, square, rectangular, concave, convex, magnetic, etc.). While the at least one engagement tip of the protrusion 108 is descried herein as being the ball tip 336, it should be understood that the ball tip 336 may be another suitable engagement component (e.g., a clasp, latch, magnet, etc.).

Figure 16:
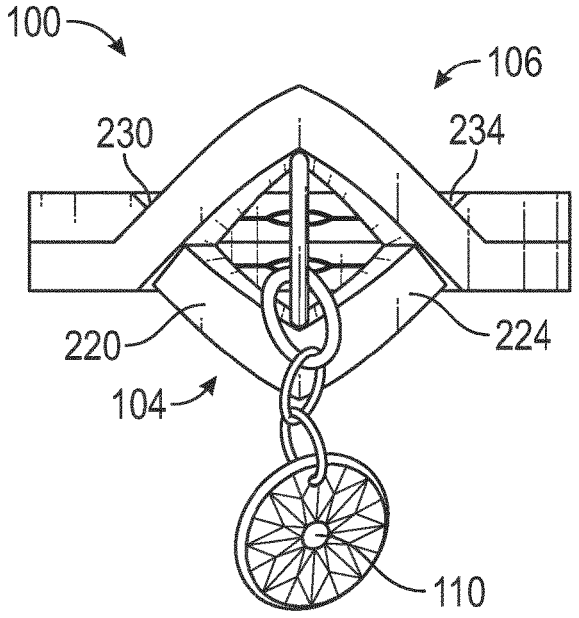
FIG. 16 is a top view of a first band and a second band of the item of jewelry of FIG. 1, coupled with a decorative item, according to some embodiments.

Referring still to FIGS. 1-9, components of the first offset 320 (e.g., the first offset arm 322, the second offset arm 324) and/or the second offset 330 (e.g., the first offset arm 332, the second offset arm 334) may be arranged so as to form an opening (e.g., window, space, void, etc.) when the first band 104 and the second band 106 are coupled. For example, and as discussed above, the first offset 320 may include a first offset arm 322 and a second offset arm 324 that extend from the first band 104, which may couple at a ninety degree angle so as to form a first triangular shape (as shown in FIGS. 1 and 4). Similarly, the second offset 330 may include a first offset arm 332 and a second offset arm 334 that extend from the second band 106, which may couple at a ninety degree angle so as to form a second triangular shape (as shown in FIGS. 1 and 4). In this regard, when the first band 104 and the second band 106 are coupled, the first triangular shape of the first offset 320 and the second triangular shape of the second offset 330 form a square opening between the first band 104 and the second band 106 (as shown in FIGS. 1 and 4). The opening may form a space or void between the first band 104 and the second band 106, for example to display a decorative item (as shown in FIG. 16). Although the components of the first offset 320 and the second offset 330 are described herein as being triangular shaped configured to form a square opening, it should be understood that the first offset 320 and/or the second offset 330 may include additional, fewer, and/or different components, for example to form different offset or window configurations. For example, the first offset 320 and the second offset 330 may be semi-circular, semi-oval, or half-hexagon shaped, and configured to form a circular, oval, or hexagonal opening (respectively) when the first band 104 and the second band 106 are coupled. In other embodiments, the first offset 320 and the second offset 330 are different shapes (e.g., half-triangular, square, rectangular, half-heart shaped, etc.), such that the first offset 320 and the second offset 330 form a shaped opening (e.g., triangular, rectangular, square, heart, etc.) when the first band 104 and the second band 106 are coupled. In other embodiments, the arms of the first offset 320 and/or the second offset 330 are not coupled (e.g., parallel, staggered, angled, etc.), such that the first offset 320 and the second offset 330 form a disconnected opening when the first band 104 and the second band 106 are coupled.

Referring generally to FIGS. 10-16, a system may be used to display one or more decorative items, according to some embodiments. The system may be the jewelry system 100 of FIGS. 1-10, which may include the item of jewelry 102 having the first band 104 and the second band 106, and at least one decorative item 110. In some embodiments, the decorative item 110 is a charm (as shown in FIGS. 10-12), and a portion of the decorative item 110 is configured to removably couple the second band 106 so as to display the decorative item 110 to a user or observer. For example, the decorative item 110 may include a connector ring 112 (as shown in FIGS. 10-12), which may be configured to removably couple the protrusion 108 (as shown in FIG. 12) so as to display the decorative item 110. The connector ring 112 may define a continuous annular ring and/or may be formed of metal; however, in other embodiments, the connector ring 112 is another suitable shape or configuration (e.g., a component of a chain, linkage, connector, shackle, webbing, etc.). In other embodiments, the decorative item 110 is a bead, gemstone, pendant, ring, medallion, locket, or other suitable decorative item. While the jewelry system 100 is described herein as including the decorative item 110 as a charm, it should be understood that the jewelry system 100 may include one or more decorative items 110, which may have the same or different configurations (e.g., the same or different decorative items).

The jewelry system 100 also includes the item of jewelry 102, according to some embodiments. The item of jewelry 102 may include the first band 104 and the second band 106, and the second band may be coupled to the protrusion 108. In some embodiments, the first band 104 and the second band 106 selectively de-couple (as shown in FIG. 10), for example in preparation of receiving the decorative item 110. In this regard, the second band 106 may be separated from the first band 104, such that the second band 106 is configured to receive a portion of the decorative item 110 (as shown in FIG. 11). The decorative item 110 may engage the protrusion 108, such that the protrusion 108 selectively couples (e.g., receives, secures, holds, etc.) the decorative item 110 (as shown in FIG. 12). For example, the protrusion 108 may be a hook that includes a curved surface, and the curved surface may engage the decorative item 110 so as to position the decorative item 110 relative to the second band 106.

Figure 13:
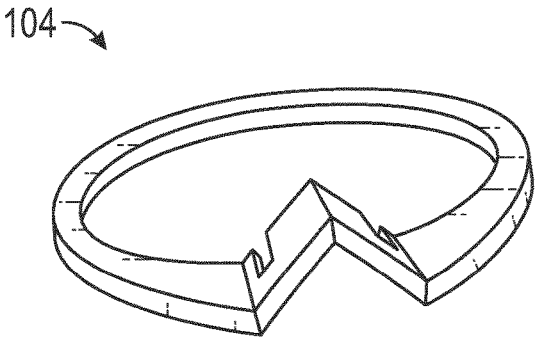
FIG. 13 is a top view of a first band of the item of jewelry of FIG. 1.
Figure 14:
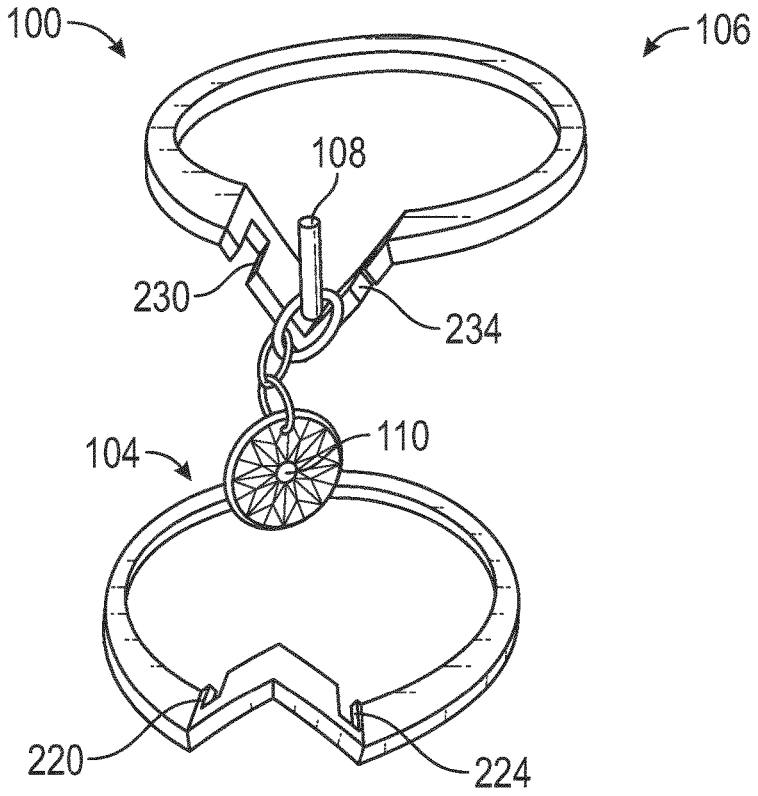
FIG. 14 is a top view of a first band and a second band of the item of jewelry of FIG. 1 coupled with a decorative item, according to some embodiments.

In some embodiments, the first band 104 is positioned (e.g., moved, manipulated, etc.) relative to the second band 106, for example in preparation of coupling the first band 104 and the second band 106 (as shown in FIG. 13). For example, with the decorative item 110 coupled to the protrusion 108, the first band 104 may be positioned such that the decorative item 110 is proximate to (e.g., within, above, etc.) an opening of the first band 104 (as shown in FIG. 14). In some embodiments, the first band 104 is positioned such that the decorative item 110 extends through the opening of the first band 104 (as shown in FIG. 15).

Figure 15:
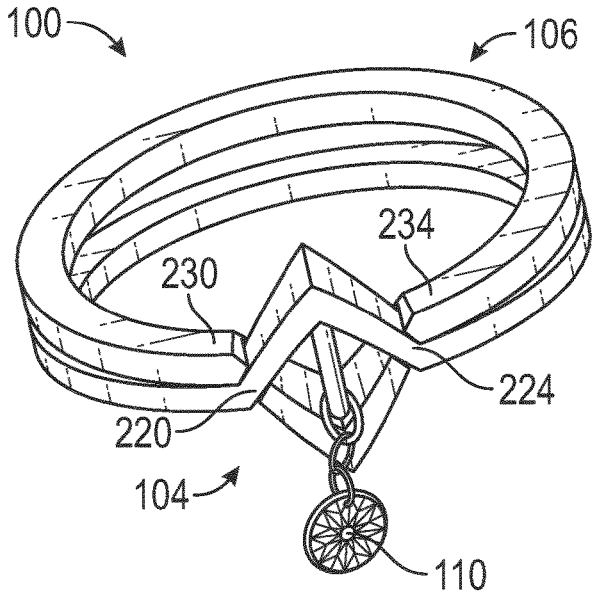
FIG. 15 is a top view of a first band and a second band of the item of jewelry of FIG. 1 coupled with a decorative item, according to some embodiments.

In some embodiments, the first band 104 is positioned relative to the second band 106 such that the at least one interlocking portion (e.g., the first notch 220) of the first band 104 is proximate to the second band 106 (as shown in FIG. 15). Further, the first band 104 may be positioned relative to the second band 106 such that the at least one interlocking portion (e.g., the first notch 230) of the second band 106 is proximate to the first band 104 (as shown in FIG. 15). For example, the first notch 220 of the first band 104 and the first notch 230 of the second band 106 may be positioned such that the first notch 220 of the first band 104 opposes the first notch 230 of the second band 106 (as shown in FIG. 15).

In some embodiments, the first band 104 is positioned relative to the second band 106 such that another interlocking portion (e.g., the second notch 224) of the first band 104 is proximate to the second band 106 (as shown in FIG. 15). Further, the first band 104 may be positioned relative to the second band 106 such that another interlocking portion (e.g., second notch 234) of the second band 106 is proximate to the first band 104 (as shown in FIG. 15). For example, the second notch 224 of the first band 104 and the second notch 234 of the second band 106 may be positioned such that the second notch 224 of the first band 104 opposes the second notch 234 of the second band 106 (as shown in FIG. 15).

The first band 104 may further be positioned (e.g., manipulated, moved, etc.) relative to the second band 106, such that the first band 104 and the second band 106 selectively couple. For example, the first band 104 may be positioned (e.g., manipulated, moved, etc.) relative to the second band 106 such that the first notch 220 of the first band 104 receives a portion of the second band 106, and the first notch 230 of the second band 106 receives a portion of the first band 104 (as shown in FIGS. 15-16). The first notch 220 of the first band 104 and the first notch 230 of the second band 106 may mate (e.g., engage, form opposing notches, etc.), such that the first band 104 and the second band 106 align (as shown in FIG. 16). Further, the first band 104 may be positioned (e.g., manipulated, moved, etc.) relative to the second band 106 such that the second notch 224 of the first band 104 receives a portion of the second band 106, and the second notch 234 of the second band 106 receives a portion of the first band 104 (as shown in FIGS. 15-16). Similar to the first notches 220, 230, the second notch 224 of the first band 104 and the second notch 234 of the second band 106 may mate (e.g., engage, form opposing notches, etc.), such that the first band 104 and the second band 106 align (as shown in FIG. 16).

In some embodiments, the first band 104 is positioned (e.g., manipulated, moved, etc.) relative to the second band 106, such that the first band 104 selectively couples the protrusion 108. For example, the first band 104 may be positioned (e.g., manipulated, moved, etc.) relative to the second band 106 such that the engagement tip (e.g., the ball tip 336) of the protrusion 108 is received by the receiver (e.g., the dimple 326) of the first band 104. The dimple 326 may receive the ball tip 336 of the protrusion 108, for example to position the first band 104 relative to the second band 106.

The first band 104 and the second band 106 may be configured to selectively couple, such that the decorative item 110 is positioned between the first band 104 and the second band 106 (as shown in FIG. 16). For example, the first band 104 and the second band 106 may couple, as discussed above, and components of the first band 104 (e.g., the first offset 320) and/or the second band 106 (e.g., the second offset 330) may form an opening (e.g., window, void, space) between the first band 104 and the second band 106 to display the decorative item 110. For example, the first band 104 and the second band 106 may couple, such that the first offset 320 and the second offset 330 form a square shaped opening, so as to display the decorative item 110 to a user or observer (as shown in FIG. 16).

The first band 104 and the second band 106 may also couple so as to limit/permit movement of the first band 104 relative to the second band 106. For example, the interlocking portions (e.g., the first notches 220, 230, the second notches 224, 234) of the first band 104 and/or the second band 106 may limit movement of the first band 104 relative to the second band 106 in a first direction (e.g., downward, horizontal, forward/backward, pitch, yaw, roll, etc.), but permit movement in a second direction (e.g., upward). Similarly, the receiver and/or the engagement tip (e.g., the dimple 326, the ball tip 336) of the first band 104 and the second band 106 may limit movement of the first band 104 relative to the second band 106 in a first direction (e.g., downward, horizontal, forward/backward, pitch, yaw, roll, etc.), but permit movement in a second direction (e.g., upward).

Figure 17:
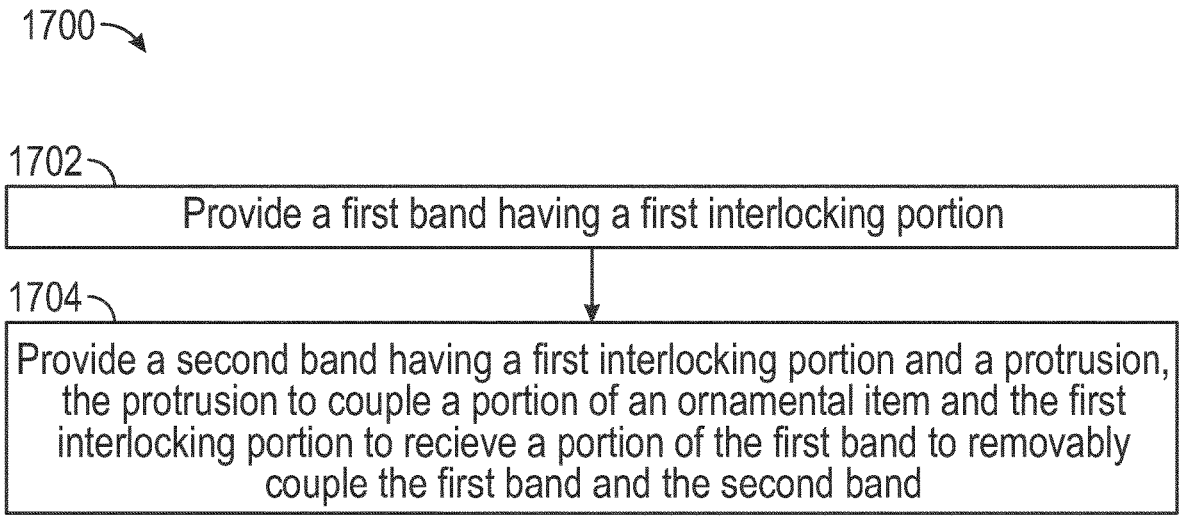
FIG. 17 is a flow diagram of a process of providing an item of jewelry, according to some embodiments.

Referring now to FIG. 17, a process 1700 for providing an item of jewelry is shown, according to some embodiments. The process 1700 may be executed to provide the components of the jewelry system 100 and/or the item of jewelry 102 of FIGS. 1-16.

At step 1702, a first band 104 is provided, according to some embodiments. The first band 104 may be continuous (e.g., uninterrupted, unbroken, uniform) and annular, and may be formed of metal or another suitable material (e.g., plastic, wood, stone, glass, etc.). The first band 104 may also include at least one interlocking portion, or a first notch 220, which may be configured to receive a portion of a second band. The first notch 220 may be positioned at a shoulder 124 of the first band 104, and/or may extend into an interior surface of the first band 104 an interlocking distance 222. The interlocking distance 222 may be a distance of half a thickness of the first band 104. In some embodiments, the first notch 220 is positioned at another portion of the first band 104 (e.g., a bridge 126, a shank 122, both shanks 122, a base 120, etc.) and/or extends into another surface of the first band 104 (e.g., a lateral surface, side surface, an exterior surface, etc.), and the interlocking distance 222 is another suitable distance (e.g., 0.5, 0.75, 1.0, 1.25, 1.5, 1.75, etc. millimeters).

The process 1700 may also include providing the first band 104 having at least another interlocking portion, or a second notch 224, which may be configured to receive a portion of a second band. The second notch 224 may be positioned at a shoulder 124 of the first band 104, for example an opposing shoulder 124 of the first band 104 relative to the first notch 220. The second notch 224 may also extend into an interior surface of the first band 104 an interlocking distance 226. The interlocking distance 226 may be a distance of half a thickness of the first band 104. In some embodiments, the interlocking distance 226 of the second notch 224 is the same as the interlocking distance 222 of the first notch 220; however, in other embodiments the interlocking distance 226 is different from the interlocking distance 222. In some embodiments, the second notch 224 is positioned at another portion of the first band 104 (e.g., a bridge 126, a shank 122, both shanks 122, a base 120, etc.) and/or extends into another surface of the first band 104 (e.g., a lateral surface, side surface, an exterior surface, etc.), and the interlocking distance 226 is another suitable distance (e.g., 0.5, 0.75, 1.0, 1.25, 1.5, 1.75, etc. millimeters).

The process 1700 may also include providing the first band 104 having an offset, or a first offset 320. The first offset 320 may extend from the first band 104, for example to form an opening to receive or display a decorative item. The first offset 320 may extend from the first band 104 in a direction that is misaligned with a plane of the first band 104, for example a direction that is misaligned with (e.g., angled from, perpendicular to, etc.) a plane that defines a base 120, shanks 122, and shoulders 124 of the first band 104. The first offset 320 may further include at least one first offset arm 322 and/or at least one second offset arm 324. As indicated above, the first offset arm 322 and/or the second offset arm 324 may extend from the first band 104 in a direction that is misaligned with a plane of the first band 104 (e.g., a plane that defines a base, shanks, and/or shoulders). The first offset arm 322 and the second offset arm 324 may extend from the first band 104 and couple at a right angle to form a triangular shape. In other embodiments, the first band 104 is provided to include additional, fewer, and/or different components (e.g., offset arms, etc.), for example to form different offset configurations (e.g. semi-circle, half-rectangular, half-square, de-coupled offset arms, staggered offset arms, etc.).

The process 1700 may include providing the first band 104 having at least one receiver, or a dimple 326. The dimple 326 may be configured to engage (e.g., receive, couple, etc.) one or more components of a second band, for example to removably couple the first band 104 and a second band. The dimple 326 may be a semi-circular concave shape and/or positioned at an interior surface of the first offset 320, for example at a junction of the first offset arm 322 and the second offset arm 324. In some embodiments, the dimple 326 is another shape or configuration (e.g., square, rectangular, concave, convex, etc.) and/or is positioned at another portion of the first offset 320 (e.g., at the first offset arm 322, at the second offset arm 324, etc.).

At step 1704, a second band 106 is provided, according to some embodiments. The second band 106 may be continuous (e.g., uninterrupted, unbroken, uniform) and annular, and may be formed of metal or another suitable material (e.g., plastic, wood, stone, glass, etc.). The second band 106 may also include at least one interlocking portion, or a first notch 230, which may be configured to receive a portion of a first band (e.g., the first band 104). The first notch 230 may be positioned at a shoulder 134 of the second band 106, and/or may extend into an exterior surface of the second band 106 an interlocking distance 232. The interlocking distance 232 may be a distance of half a thickness of the second band 106. In some embodiments, the first notch 230 is positioned at another portion of the second band 106 (e.g., a bridge 136, a shank 132, both shanks 132, a base 130, etc.) and/or extends into another surface of the second band 106 (e.g., a lateral surface, side surface, interior surface, etc.), and the interlocking distance 232 is another suitable distance (e.g., 0.5, 0.75, 1.0, 1.25, 1.5, 1.75, etc. millimeters).

The second band 106 also includes a protrusion 108, according to some embodiments. The protrusion 108 may extend from the second band 106, and may be configured to removably couple (e.g., receive, secure, hold, etc.) one or more decorative items. The protrusion 108 may extend from an offset of the second band 106, for example into an opening formed by the offset of the second band 106. The protrusion 108 may extend from the second band 106 in a direction that is misaligned with (e.g., angled from, perpendicular to, etc.) a plane of the second band 106, for example a plane that defines a base 130, shanks 132, and shoulders 134 of the second band 106. In some embodiments, the protrusion 108 is a hook having a curved surface; however, in other embodiments the protrusion is a peg, catch, clasp, pin, clip, or another suitable projection configured to removably couple a decorative item. The protrusion 108 may also removably couple the first band 104. For example, the protrusion 108 may engage the first band 104 when the first band 104 is coupled to the second band 106 to limit movement of the first band 104 relative to the second band 106 (e.g., downward, horizontal, forward/backward, pitch, yaw, roll, etc.).

In some embodiments, the first notch 220 of the first band 104 receives a portion of the second band 106, and the first notch 230 of the second band 106 receives a portion of the first band 104, such that the first band 104 and the second band 106 removably couple. For example, the first notch 220 of the first band 104 may receive a portion of the second band 106 proximate to the first notch 230 of the second band 106, and the first notch 230 of the second band 106 may receive a portion of the first band 104 proximate to the first notch 220 of the first band 104. In this regard, the first notch 220 of the first band 104 and the first notch 230 of the second band 106 may be configured to mate (e.g., engage, form opposing notches, etc.), such that the first band 104 and the second band 106 are removably coupled and limit/permit selective movement. As indicated above, the interlocking distance 222 of the first notch 220 of the first band 104, and the interlocking distance 232 of the first notch 230 of the second band 106 may be the same, such that the first band 104 and the second band 106 may align (e.g., flush on an exterior surface of the bands, etc.) when coupled. In other embodiments, the interlocking distance 222 and the interlocking distance 232 are different, such that the first band 104 and the second band 106 form another configuration (e.g., staggered, stair-stepped, etc.) when coupled.

The process 1700 may also include providing the second band 106 having at least another interlocking portion, or a second notch 234, which may be configured to receive a portion of a first band (e.g., the first band 104). The second notch 234 may be positioned at a shoulder 134 of the second band 106, for example an opposing shoulder 134 of the second band 106 relative to the first notch 230. The second notch 234 may also extend into an exterior surface of the second band 106 an interlocking distance 236. The interlocking distance 236 may be a distance of half a thickness of the second band 106, which may be the same as the interlocking distance 232 of the first notch 230. In other embodiments, the second notch 234 is positioned at another portion of the second band 106 (e.g., a bridge 136, a shank 132, both shanks 132, a base 130, etc.) and/or extends into another surface of the second band 106 (e.g., a lateral surface, side surface, interior surface, etc.), and the interlocking distance 236 is another suitable distance (e.g., 0.5, 0.75, 1.0, 1.25, 1.5, 1.75, etc. millimeters).

In some embodiments, the second notch 224 of the first band 104 receives a portion of the second band 106, and the second notch 234 of the second band 106 receives a portion of the first band 104, such that the first band 104 and the second band 106 removably couple. For example, the second notch 224 of the first band 104 may receive a portion of the second band 106 proximate the second notch 234 of the second band 106, and the second notch 234 of the second band 106 may receive a portion of the first band 104 proximate the second notch 224 of the first band 104. In this regard, the second notch 224 of the first band 104 and the second notch 234 of the second band 106 may be configured to mate (e.g., engage, form opposing notches, etc.), such that the first band 104 and the second band 106 removably couple and limit/permit selective movement. In some embodiments, the interlocking distances (e.g., interlocking distance 226, interlocking distance 236) of the second notches 224, 234 are the same, such that the first band 104 and the second band 106 are aligned when coupled; however, in other embodiments the interlocking distances 226, 236 are different.

The process 1700 may also include providing the second band 106 having an offset, or a second offset 330. The second offset 330 may extend from the second band 106, for example to form an opening to receive or display a decorative item. The second offset 330 may extend from the second band 106 in a direction that is misaligned with a plane of the second band 106, for example a direction that is misaligned with (e.g., angled from, perpendicular to, etc.) a plane that defines a base 130, shanks 132, and shoulders 134 of the second band 106. In some embodiments, the second offset 330 extends from the second band 106 in a direction that opposes a direction the first offset 320 extends from the first band 104. The second offset 330 may further include at least one first offset arm 332 and/or at least one second offset arm 334. As indicated above, the first offset arm 332 and/or the second offset arm 334 may extend from the second band 106 in a direction that is misaligned with a plane of the second band 106 (e.g., a plane that defines a base, shanks, and/or shoulders). The first offset arm 332 and the second offset arm 334 may extend from the second band 106 and couple at a right angle to form a triangular shape. In some embodiments, the second band 106 is provided to include additional, fewer, and/or different components (e.g., offset arms, etc.), for example to form different offset configurations (e.g., semi-circle, half-rectangular, half-square, de-coupled offset arms, staggered offset arms, etc.).

As discussed above, the process 1700 may also include providing the second band 106 having the protrusion 108. In some embodiments, the protrusion 108 extends from the second offset 330, for example toward a plane of the second band 106 (e.g., into an opening formed by the second offset 330). The protrusion 108 may extend from an interior surface of the second offset 330, for example from a junction of the first offset arm 332 and the second offset arm 334, or another suitable portion of the second offset 330. The protrusion 108 may also included at least one engagement tip, or a ball tip 336, which may be configured to removably couple the first band 104. For example, the ball tip 336 may be configured to be received by a receiver (e.g., the dimple 326) of the first band 104, so as to selectively couple the first band 104 and the second band 106. Further, the ball tip 336 may be received by the dimple 326 so as to limit movement of the first band 104 in a first direction (e.g., downward, forward/backward, pitch, yaw, roll, etc.) and/or permit movement of the first band 104 in a second direction (e.g., upward).

As an illustrative example, a user may desire to have a system that offers versatile and interchangeable display of one or more decorative items, for example to accommodate user preferences, use sceneries, and/or design considerations. A user may obtain the jewelry system 100, which includes the item of jewelry 102 and/or one or more decorative items 110. The item of jewelry 102 may de-couple, for example in preparation for receiving the decorative item 110. In some embodiments, the first band 104 and the second band 106 de-couple, for example by manipulating (e.g., moving, positioning, etc.) the first band 104 relative to the second band 106. The second band 106 may be separated from the first band 104, and the second band 106 may receive a portion of the decorative item 110 (e.g., the connector ring 112) at the protrusion 108. With the second band 106 (e.g., protrusion 108) coupled to the decorative item 110 (e.g., the connector ring 112), the first band 104 may be positioned such that the decorative item 110 extends through an opening of the first band 104. Further, the first band 104 may be positioned such that the interlocking portions of the first band 104 and the second band 106 (e.g., the first notches 220, 230, the second notches 224, 234, etc.) are proximate to one another. The first band 104 may further be manipulated (e.g., positioned, moved, etc.), such that a portion of the first band 104 is received by at least one interlocking portion of the second band 106 (e.g., the first notch 230, the second notch 234) and/or a portion of the second band 106 is received by at least one interlocking portion of the first band 104 (e.g., the first notch 220, the second notch 224). Further, the first band 104 may be manipulated (e.g., positioned, moved, etc.), such that a receiver of the first band 104 (e.g., the dimple 326) receives an engagement tip (e.g., the ball tip 336) of the protrusion 108, so as to position the first band 104 relative to the second band 106. The interlocking portions (e.g., the first notches 220, 230, the second notches 224, 234, etc.) and/or the receiver and engagement tip (e.g., the dimple 326, the ball tip 336) of the first band 104 and the second band 106 may interface so as to couple the first band 104 and the second band 106 to secure the decorative item 110. The jewelry system 100 (e.g., the item of jewelry 102 with the decorative item 110) may engage an anatomical feature of a user, for example to display the decorative item 110 to the user or an observer. After use of the jewelry system 100, the first band 104 and the second band 106 may de-couple, as discussed above, for example to remove the decorative item 110 and/or incorporate another decorative item with the item of jewelry 102.

As utilized herein with respect to numerical ranges, the terms "approximately," "about," "substantially," and similar terms generally mean+/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above.

It is important to note that any element disclosed in one embodiment may be incorporated or utilized with any other embodiment disclosed herein. For example, the protrusion 108 of the exemplary embodiment described in at least FIGS. 1 and 8 may be incorporated in the first band 104 of the exemplary embodiment described in at least FIGS. 1-16. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. An item of jewelry to display a decorative item, comprising:

a first band having a shank, an offset extending from the first band, at least a first notch, and a dimple, the offset comprising a first arm and a second arm extending from the first band and meeting at a connection point to define a first opening, the dimple extending into the offset of the first band at the connection point; and a second band having a shank, an offset extending from the second band, at least a first notch, and a protrusion including a ball tip at an end of the protrusion, the offset comprising a first arm and a second arm extending from the second band and meeting at a connection point to define a second opening, the protrusion coupled with the offset of the second band at the connection point and extending into the second opening, wherein the protrusion receives a portion of the decorative item to removably couple the decorative item to the second band;

wherein in response to the protrusion receiving the portion of the decorative item, the first band is configured to move relative to the second band such that the shank of the first band is adjacent the shank of the second band and movable along the shank of the second band in a first vertical direction;

wherein as the shank of the first band slides along the shank of the second band in the first vertical direction the first notch of the first band receives a portion of the second band proximate the first notch of the second band, and the first notch of the second band receives a portion of the first band proximate the first notch of the second band so as to removably couple the first band and the second band;

wherein as the first notch of the first band receives the portion of the second band and the first notch of the second band receives the portion of the first band the dimple of the first band receives the ball tip of the protrusion to form an engagement between the ball tip and the dimple to couple the first band and the second band;

wherein the engagement between the ball tip and the dimple is configured to restrict translational movement of the first band relative to the second band in a plurality of directions including the first vertical direction and a first horizontal direction perpendicular to the first vertical direction; and wherein the engagement between the ball tip and the dimple is configured to couple the first band and the second band such that (i) the protrusion extends between the second band and the first band in the second opening formed by the offset of the second band and the first opening formed by the offset in the first band and (ii) the decorative item is freely movable along the protrusion within space provided by the first opening and the second opening.

2. The item of jewelry of claim 1, wherein the first band includes a second notch, and the first notch and the second notch of the first band extend into an interior surface of the first band.

3. The item of jewelry of claim 2, wherein the second band includes a second notch, and the first notch and the second notch of the second band extend into an exterior surface of the second band.

4. The item of jewelry of claim 3, wherein the first notch and the second notch of the second band extend a distance of half a thickness of the second band into the exterior surface of the second band.

5. The item of jewelry of claim 3, wherein the second notch of the first band receives a portion of the second band proximate the second notch of the second band.

6. The item of jewelry of claim 3, wherein the first notch of the first band receives a portion of the second band proximate the first notch of the second band, and the second notch of the first band receives a portion of the second band proximate the second notch of the second band, so as to limit translational movement of the first band relative to the second band and permit vertical movement of the first band relative to the second band.

7. The item of jewelry of claim 1, wherein the protrusion includes a hook including the ball tip configured to engage the dimple of the first band to couple the first band and the second band.

8. The item of jewelry of claim 7, wherein the hook extends from the second band in a direction perpendicular to a plane defined by the second band.

9. The item of jewelry of claim 1, wherein the offset of the first band extends from the first band in a direction misaligned from a plane defined by the shank of the first band, and wherein the first arm of the first band extends from the first band along a first axis and the second arm of the first band extends from the first band along a second axis.

10. The item of jewelry of claim 9, wherein the first axis and the second axis are perpendicular, and the first axis and the second axis are misaligned from a central axis of the shank of the first band.

11. A method of providing an item of jewelry, the method comprising:

providing a first band having a shank, an offset extending from the first band, at least a first notch, and a dimple, the offset comprising a first arm and a second arm extending from the first band and meeting at a connection point to define a first opening, the dimple extending into the offset of the first band at the connection point; and providing a second band having a shank, an offset extending from the second band, at least a first notch, and a protrusion including a ball tip at an end of the protrusion, the offset comprising a first arm and a second arm extending from the second band and meeting at a connection point to define a second opening, the protrusion coupled with the offset of the second band at the connection point and extending into the second opening, wherein the protrusion receives a portion of the decorative item to removably couple the decorative item to the second band;

in response to the protrusion receiving the portion of the decorative item, moving the first band relative to the second band such that the shank of the first band is adjacent the shank of the second band and movable along the shank of the second band in a first vertical direction;

wherein as the shank of the first band slides along the shank of the second band in the first vertical direction the first notch of the first band receives a portion of the second band proximate the first notch of the second band, and the first notch of the second band receives a portion of the first band proximate the first notch of the second band so as to removably couple the first band and the second band;

wherein as the first notch of the first band receives the portion of the second band and the first notch of the second band receives the portion of the first band the dimple of the first band receives the ball tip of the protrusion to form an engagement between the ball tip and the dimple to couple the first band and the second band;

wherein the engagement between the ball tip and the dimple is configured to restrict translational movement of the first band relative to the second band in a plurality of directions including the first vertical direction and a first horizontal direction perpendicular to the first vertical direction; and wherein the engagement between the ball tip and the dimple is configured to couple the first band and the second band such that (i) the protrusion extends between the second band and the first band in the second opening formed by the offset of the second band and the first opening formed by the offset in the first band and (ii) the decorative item is freely movable along the protrusion within space provided by the first opening and the second opening.

12. The method of claim 11, further comprising:

providing the first band including a second notch; and providing the second band including a second notch, wherein the second notch of the first band receives a portion of the second band proximate the second notch of the second band, so as to limit translational movement of the first band relative to the second band and permit vertical movement of the first band relative to the second band.

13. The method of claim 12, further comprising providing the protrusion including a hook having the ball tip configured to engage the dimple of the first band to couple the first band and the second band, the hook extending from the second band in a direction perpendicular to a plane defined by the second band.

14. A jewelry system, comprising:

a decorative item;

a first band having a shank, an offset extending from the first band, at least a first notch, and a dimple, the offset comprising a first arm and a second arm extending from the first band and meeting at a connection point to define a first opening, the dimple extending into the offset of the first band at the connection point; and a second band having a shank, an offset extending from the second band, at least a first notch, and a protrusion including a ball tip at an end of the protrusion, the offset comprising a first arm and a second arm extending from the second band and meeting at a connection point to define a second opening, the protrusion coupled with the offset of the second band at the connection point and extending into the second opening, wherein the protrusion receives a portion of the decorative item to removably couple the decorative item to the second band;

wherein in response to the protrusion receiving the portion of the decorative item, the first band is configured to move relative to the second band such that the shank of the first band is adjacent the shank of the second band and movable along the shank of the second band in a first vertical direction;

wherein as the shank of the first band slides along the shank of the second band in the first vertical direction the first notch of the first band receives a portion of the second band proximate the first notch of the second band, and the first notch of the second band receives a portion of the first band proximate the first notch of the second band so as to removably couple the first band and the second band;

wherein as the first notch of the first band receives the portion of the second band and the first notch of the second band receives the portion of the first band the dimple of the first band receives the ball tip of the protrusion to form an engagement between the ball tip and the dimple to couple the first band and the second band;

wherein the engagement between the ball tip and the dimple is configured to restrict translational movement of the first band relative to the second band in a plurality of directions including the first vertical direction and a first horizontal direction perpendicular to the first vertical direction; and wherein the engagement between the ball tip and the dimple is configured to couple the first band and the second band such that (i) the protrusion extends between the second band and the first band in the second opening formed by the offset of the second band and the first opening formed by the offset in the first band and (ii) the decorative item is freely movable along the protrusion within space provided by the first opening and the second opening.

15. The jewelry system of claim 14, the first band including a second notch and the second band including a second notch, wherein the second notch of the first band receives a portion of the second band proximate the second notch of the second band, so as to limit translational movement of the first band relative to the second band and permit vertical movement of the first band relative to the second band.

16. The jewelry system of claim 14, the protrusion including a hook having the ball tip configured engage the dimple of the first band to couple the first band and the second band, the hook extending from the second band in a direction perpendicular to a plane defined by the second band.

17. The jewelry system of claim 14, the offset of the first band extends from the first band in a first direction misaligned from a plane defined by the shank of the first band, the offset of the second band extends from the second band in a second direction misaligned from a plane defined by the shank second band, wherein the first offset and the second offset are planar and extend in opposing directions.

18. The jewelry system of claim 1, wherein an engagement between the first notch of the first band and the portion of the second band and an engagement between the first notch of the second band and the portion of the first band are configured to restrict translational movement of the first band relative to the second band in the first horizontal direction and a second horizontal direction, the second horizontal direction perpendicular to the first vertical direction and opposite the first horizontal direction.

* * * * *